US009271540B1

(12) United States Patent
MacNeill et al.

(10) Patent No.: US 9,271,540 B1
(45) Date of Patent: Mar. 1, 2016

(54) CLEATS AND FOOTWEAR FOR PROVIDING CUSTOMIZED TRACTION

(71) Applicant: CLEATS LLC, Marlborough, MA (US)

(72) Inventors: Harris L. MacNeill, Northborough, MA (US); Armand J. Savoie, Gardner, MA (US); Jeffrey M. Dow, Paxton, MA (US)

(73) Assignee: CLEATS LLC, Marlborough, MA (US)

( * ) Notice: Subject to any disclaimer, the term of this patent is extended or adjusted under 35 U.S.C. 154(b) by 0 days.

(21) Appl. No.: 14/634,090

(22) Filed: Feb. 27, 2015

Related U.S. Application Data

(60) Continuation of application No. 14/048,355, filed on Oct. 8, 2013, now Pat. No. 9,066,554, which is a continuation of application No. 13/452,001, filed on Apr. 20, 2012, now Pat. No. 8,601,725, which is a (Continued)

(51) Int. Cl.
*A43C 15/02* (2006.01)
*A43B 5/00* (2006.01)
*A43C 15/16* (2006.01)

(52) U.S. Cl.
CPC ..... *A43B 5/001* (2013.01); *A43C 15/162* (2013.01); *A43C 15/164* (2013.01); *A43C 15/168* (2013.01)

(58) Field of Classification Search
CPC ..... A43B 5/001; A43C 15/16; A43C 15/162; A43C 15/164; A43C 15/165; A43C 15/167; A43C 15/168
USPC ..... 36/134, 67 A, 67 D; D2/962
See application file for complete search history.

(56) References Cited

U.S. PATENT DOCUMENTS

| | | | | |
|---|---|---|---|---|
| 3,512,275 | A | 5/1970 | Leavitt | |
| 3,656,245 | A | 4/1972 | Wilson | 36/67 D |
| 4,014,114 | A | 3/1977 | Jordan et al. | 36/67 D |
| 5,259,129 | A | 11/1993 | Deacon et al. | 36/127 |
| D371,895 | S | 7/1996 | McMullin | D2/962 |
| 5,794,367 | A | 8/1998 | Carroll | 36/134 |
| 5,860,228 | A * | 1/1999 | Bathum | 36/127 |
| 5,887,371 | A | 3/1999 | Curley, Jr. | 36/127 |
| 5,996,260 | A | 12/1999 | MacNeill | 36/134 |
| 6,009,640 | A | 1/2000 | Deacon et al. | 36/127 |

(Continued)

FOREIGN PATENT DOCUMENTS

| | | | |
|---|---|---|---|
| DE | 2540426 | 3/1977 | A43C 15/16 |
| DE | 3811513 | 10/1989 | A43C 15/16 |

(Continued)

*Primary Examiner* — Ted Kavanaugh
(74) *Attorney, Agent, or Firm* — Sunstein Kann Murphy & Timbers LLP

(57) ABSTRACT

A removable cleat includes a plurality of projections, dividing into sets, with each set of projections made of different materials. The cleat includes a coupling element, for attachment to a shoe, and a ground contacting element. The ground contacting element contains a plurality of projections, with the projections divided into at least two sets. The projections may be disposed about the perimeter of the ground contacting element, such that each set of projections does not extend more than half the perimeter. Additionally, some of the plurality of projections may be located interior to the perimeter. Further, each set of projections may be oriented in a particular direction with respect to a plane formed by the perimeter. Each interspersed set of projections may be made of a different material, or each projection may itself be made of a different material.

17 Claims, 10 Drawing Sheets

Related U.S. Application Data division of application No. 12/495,045, filed on Jun. 30, 2009, now Pat. No. 8,181,367, which is a division of application No. 11/938,140, filed on Nov. 9, 2007, now Pat. No. 7,726,047, which is a division of application No. 11/043,691, filed on Jan. 26, 2005, now abandoned.

(60) Provisional application No. 60/539,244, filed on Jan. 26, 2004, provisional application No. 60/557,488, filed on Mar. 30, 2004.

(56) References Cited

U.S. PATENT DOCUMENTS

| | | | | |
|---|---|---|---|---|
| 6,023,860 | A | 2/2000 | McMullin | 36/127 |
| 6,041,526 | A | 3/2000 | Collins | 36/127 |
| 6,052,923 | A | 4/2000 | McMullin | 36/127 |
| 6,094,843 | A | 8/2000 | Curley, Jr. | 36/127 |
| D432,770 | S | 10/2000 | Breault et al. | D2/962 |
| 6,138,386 | A | 10/2000 | Singer et al. | 36/127 |
| 6,167,641 | B1 | 1/2001 | McMullin | 36/127 |
| D439,733 | S * | 4/2001 | Savoie | D2/962 |
| 6,209,230 | B1 | 4/2001 | Curley, Jr. | 36/127 |
| D449,431 | S | 10/2001 | Savoie | D2/962 |
| 6,305,104 | B1 | 10/2001 | McMullin | 36/127 |
| D452,062 | S * | 12/2001 | Savoie | D2/962 |
| D452,063 | S * | 12/2001 | Savoie | D2/962 |
| 6,327,797 | B1 | 12/2001 | Deacon et al. | 36/127 |
| 6,338,208 | B1 * | 1/2002 | Waterbury | 36/134 |
| 6,354,021 | B1 | 3/2002 | Deacon et al. | 36/127 |
| 6,530,162 | B1 | 3/2003 | Carroll | 36/134 |
| D473,699 | S * | 4/2003 | Savoie | D2/962 |
| 6,675,505 | B2 * | 1/2004 | Terashima | 36/134 |
| 6,775,931 | B2 | 8/2004 | Hokkirigawa et al. | 36/134 |
| 6,823,613 | B2 | 11/2004 | Kelly et al. | 36/134 |
| 6,834,445 | B2 | 12/2004 | McMullin | 36/127 |
| 6,834,446 | B2 | 12/2004 | McMullin | 36/134 |
| 6,904,707 | B2 | 6/2005 | McMullin | 36/127 |
| D509,050 | S | 9/2005 | Savoie | D2/962 |
| 7,040,043 | B2 | 5/2006 | McMullin | 36/127 |
| 7,047,674 | B1 | 5/2006 | Garvie | 36/134 |
| 7,073,280 | B2 | 7/2006 | Terashima | 36/127 |
| 7,073,281 | B2 * | 7/2006 | Terashima | 36/134 |
| 8,601,725 | B1 | 12/2013 | MacNeill et al. | 36/134 |
| 2001/0011429 | A1 | 8/2001 | Peabody | 36/134 |
| 2002/0152644 | A1 | 10/2002 | Hokkirigawa et al. | 36/134 |
| 2003/0033735 | A1 | 2/2003 | Ijiri | 36/134 |
| 2003/0131502 | A1 | 7/2003 | Terashima | 36/127 |
| 2003/0172556 | A1 | 9/2003 | Terashima | 36/134 |
| 2004/0010944 | A1 | 1/2004 | McMullin | 36/127 |
| 2004/0040182 | A1 | 3/2004 | McMullin | 36/134 |
| 2008/0271346 | A1 | 11/2008 | Farmer | 36/134 |
| 2009/0211118 | A1 | 8/2009 | Krikorian et al. | 36/134 |

FOREIGN PATENT DOCUMENTS

| | | | |
|---|---|---|---|
| EP | 0524861 | 1/1993 | A43C 15/16 |
| FR | 2679421 | 1/1993 | A43C 15/16 |

* cited by examiner

CLEATS AND FOOTWEAR FOR PROVIDING CUSTOMIZED TRACTION

RELATED CASES

This patent application is a continuation application of U.S. patent application Ser. No. 14/048,355 filed Oct. 8, 2013, which is a continuation application of U.S. patent application Ser. No. 13/452,001, filed Apr. 20, 2012, which is a divisional application of U.S. patent application Ser. No. 12/495,045, filed Jun. 30, 2009, which is a divisional application of U.S. patent application Ser. No. 11/938,140, filed Nov. 9, 2007, which is a divisional application of U.S. patent application Ser. No. 11/043,691, filed Jan. 26, 2005, which claims priority from U.S. provisional application Nos. 60/539,244 and 60/557,488 filed Jan. 26, 2004 and Mar. 30, 2004 respectively. Accordingly, the current application also claims priority from U.S. provisional application Nos. 60/539,244 and 60/557,488. All of the aforementioned applications are incorporated herein by reference.

TECHNICAL FIELD AND BACKGROUND ART

The present invention relates to removable cleats for athletic shoes, in particular, removable cleats for golf shoes.

Athletic shoe cleats, in particular golf cleats, have been subject to changing designs in recent years, to attempt to provide users with a variety of advantages. For many years, a cleat took a simple form of a spike, usually made of metal, attached the bottom of a shoe. Because such spikes could damage non-athletic surfaces, and some athletic surfaces as well, variations have been made from the simple form. For example, UK Patent Application 2,098,457 to Perks, discloses surrounding a spike element of a cleat with soft material, to decrease damage done to surfaces. Other designs do not use metal spikes but rather projections of different shapes, typically made of plastic, to lessen damage to surfaces; an example can be seen in U.S. design Pat. D432,770 to Breault et al., which shows projections of different heights. Another design, which provides a directional golf cleat, is the CHAMP TRAC™ spike made by MacNeill Engineering Company, Inc.

SUMMARY OF THE INVENTION

In a first embodiment of the invention there is provided a removable cleat. The removable cleat has a coupling element and a ground-engaging element. The ground-engaging element has a perimeter with a plurality of projections. The projections may be divided into at least a first set of projections, made of a first material, and at least a second set of projections, made of a second material. Every other projection may be of the first set and interspersed with the projections of the second set. Further, the projections may include at least one projection extending beyond the perimeter of the ground-engaging element, and at least one projection not extending beyond the perimeter of the ground-engaging element. In addition, at least one of the plurality of projections may project in a direction perpendicular to a plane formed by the perimeter of the ground-engaging element.

In a related embodiment, the cleat may be a directional cleat, with some projections not extending beyond more than half of the perimeter of the ground-engaging element. In an alternative embodiment, none of the projections extend beyond the perimeter of the ground-engaging element.

In a further related embodiment, the first set of projections may be longer than the second set of projections. In addition, the first material may be softer than the second material. In yet a further related embodiment, the removable cleat may further include a third material that possesses a different characteristic from the first and second materials. Further, the coupling element may be made of the third material. In yet another related embodiment, two of the materials may be characterized by a different color, to ease installation of the cleat in the proper direction.

In another embodiment of the invention there is provided a removable cleat having a coupling element and a ground-engaging element, wherein the ground-engaging element has a perimeter with a plurality of projections. Several projections may be oriented substantially perpendicular to the ground or angled inwardly, and several projections may be angled outwardly to extend beyond the perimeter of the ground-engaging element. Preferably, the outwardly angled projections do not extend beyond more than half of the perimeter of the ground-engaging element. The cleat may have one set of projections longer than another set of projections. One set of projections may be made of a softer material than another set. In a preferred embodiment, the longer projections may be made of a softer material, and the shorter projections made of a harder material. The two sets may be interspersed. Further, the coupling element may be made of a third material. In yet another related embodiment, two of the materials may be characterized by different colors, to ease installation of the cleat in the proper direction.

In yet another embodiment, there is provided a rotating oversized cleat for a shoe. The rotating oversized cleat comprises a coupling element, such that the cleat is removable, and a ground-engaging element. The ground-engaging element has a perimeter with a plurality of projections. Some of the projections may not extend beyond the perimeter, and the projections may be divided into at least a first set of projections made of a first material and at least a second set of projections made of a second material. In addition, the cleat may further include a ratchet, such that the oversized cleat may rotate in only one direction.

In a related embodiment, the ground-engaging element may further include a center portion and an outer portion, wherein the outer portion may be capable of rotation, and the center portion may remain static with respect to the shoe unless the oversized cleat is removed. In addition, the coupling element may include an attachment structure including at least three equally spaced radial coupling projections. Each coupling projection may be asymmetric with respect to an axis projecting radially outward from the center of the attachment structure through the radial center of the projection, and the radial center of the coupling projection may have a convex curved radial end. The coupling projection may thus be capable of interacting with a corresponding cleat receptacle so that less force is required to engage the cleat with the receptacle than to disengage the cleat from the receptacle.

In a related embodiment, there is provided the outsole of a shoe, comprising a rotating oversized cleat described above and at least one other removable cleat. The at least one other removable cleat of the outsole may be a directional cleat.

In still another embodiment, there is provided a removable cleat for coupling to a shoe sole. The cleat includes a coupling element and a surface-engaging element. The surface-engaging element includes a perimeter and a plurality of projections. The projections include at least a first set of projections, which may be made of a first material and a second set of projections, which may be made of a second material. The first set of projections is oriented in a direction that is substantially perpendicular to a plane formed by the perimeter. The second set of projections is oriented in a direction that is substantially parallel to a plane formed by the perimeter. Further, the second set of projections may be longer than the first set of projections, and the first material may be softer than the second material.

In still another embodiment, the ground-engaging element has a bottom-most portion made of a first material, an intermediate portion located above the bottom-most portion and made of a second material, and a base portion located above the intermediate portion and made of the second material or a third material. The base-portion's material is harder than the first material. The intermediate portion forms flexible cantilevered fingers. The bottom-most portion may be located at the cleats' central axis, and the intermediate and base portions may be wider than the bottom-most portion. The base portion may include on its bottom surface crenellations, which may be located to receive the flexible cantilevered fingers when the flexible cantilevered fingers are bent upwardly.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1:
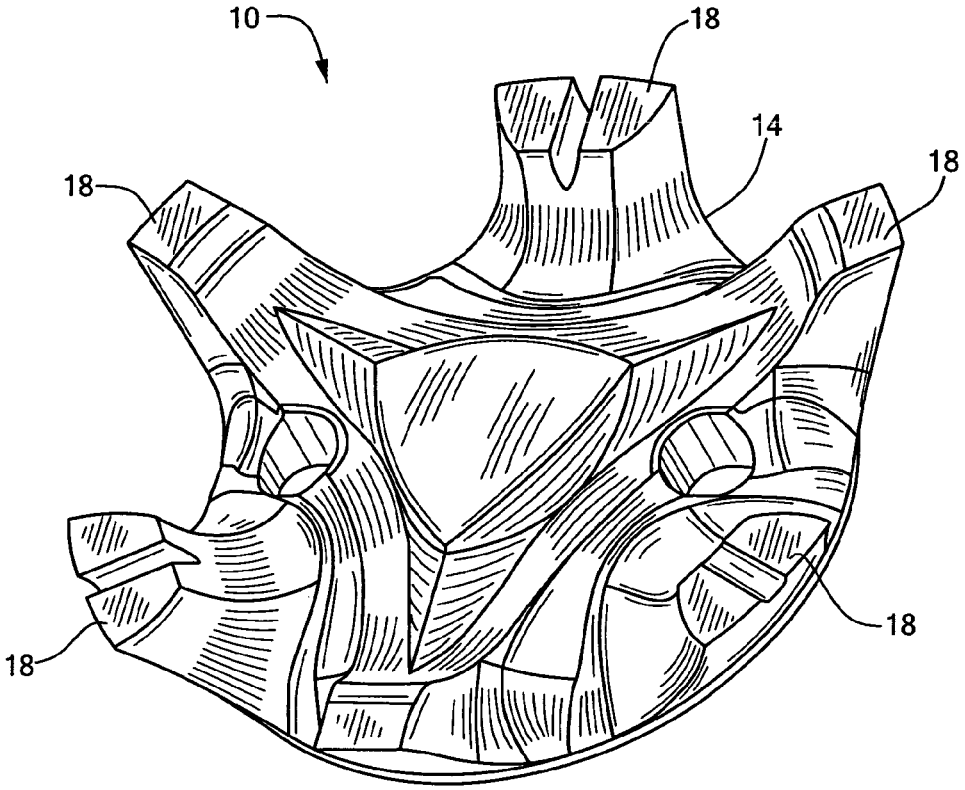
FIG. 1 is a perspective view of a removable cleat according to one embodiment of the current invention.
Figure 2:
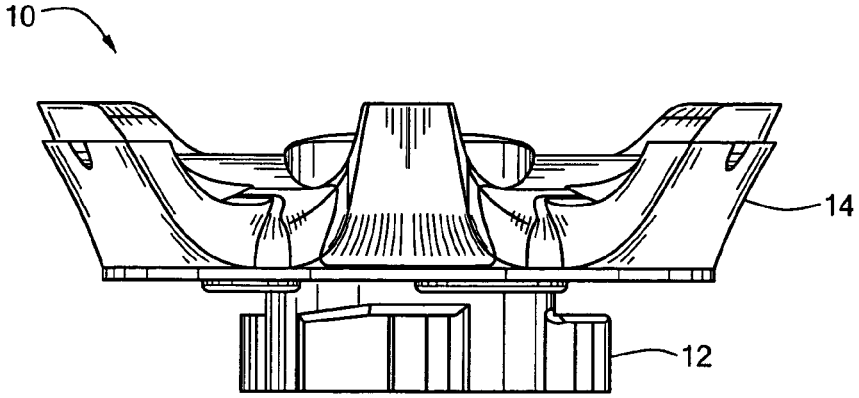
FIG. 2 is a side view of the cleat shown in FIG. 1.

FIGS. 1 and 2 illustrate a removable cleat 10 according to an embodiment of the current invention. The removable cleat 10 has a coupling element 12, which is shown in FIG. 2, and a ground-engaging element 14. The coupling element 12 may be any suitable element. One example of a suitable coupling element includes, but is not limited to, a threaded stud. This includes but is not limited to studs with conventional threading, and studs using multiple-start threads, such as shown in U.S. Pat. No. 5,974,700. A further example of a suitable element is a connector such as that described in U.S. Pat. No. 6,631,571. The example of a suitable coupling element shown in FIG. 2 is based on the MacNeill Engineering Q-lok™ System (described in, for example, U.S. Pat. No. 5,768,809, issued Jun. 23, 1998, which is incorporated herein by reference).

Disposed at the perimeter of the cleat is a plurality of projections 18. The projections 18 bear the weight of a user on a surface, when the removable cleat 10 is attached to an athletic shoe worn by the user, but the projections are preferably made of plastic so as to be less likely to damage the surface. When weight is applied to the cleat 10, the projections 18 flex in an upward direction, away from the surface, as well as in an outward direction, away from the center of the ground-engaging element 14.

Figure 3:
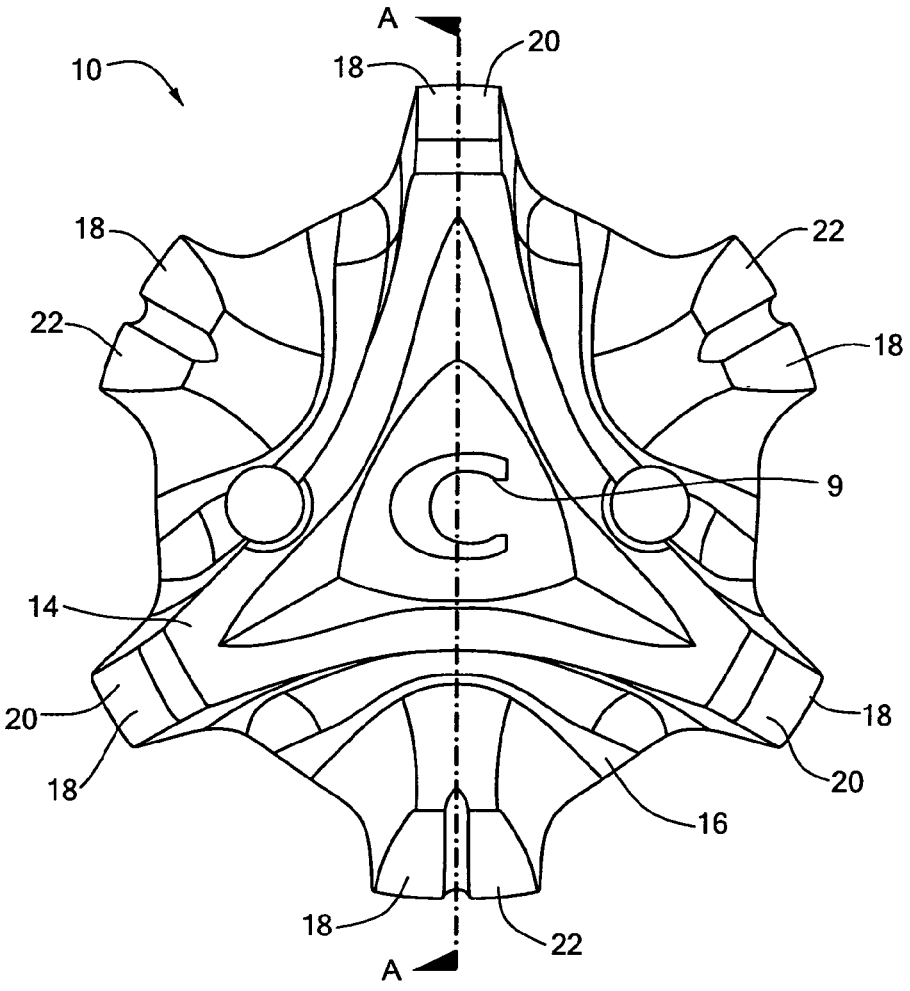
FIG. 3 is a bottom view of a cleat similar to the one shown in FIG. 1, but which includes a logo.

FIG. 3 shows a version of the FIG. 1 cleat, modified to include a logo 9 on a bottom surface. As can be seen in FIG. 3, the ground-engaging element 14 includes a perimeter 16. The perimeter 16 may be a circumference, if the ground-engaging element is circular in shape. As with the cleat shown in FIGS. 1 and 2, the FIG. 3 cleat has a plurality of projections 18 at the perimeter 16. The plurality of projections 18 may also be disposed on perimeter 16 such that the projections 18 do not extend beyond perimeter 16. For example, the plurality of projections 18 may extend in a direction substantially perpendicular to a plane formed by the perimeter, i.e., substantially perpendicular to the ground. Alternatively, some projections may extend beyond the perimeter and some may extend in a direction substantially perpendicular to the ground, as shown in the embodiments shown in FIGS. 5-11, as discussed below.

In the embodiments shown in FIGS. 1-3, the projections 18 are divided into two sets of projections, a first set 20 and a second set 22. The first set 20 is composed of a first material, and the second set 22 is composed of a second material. Further sets may be made in this manner, such that there could be a third set of projections made of a third material, a fourth set of projections made of a fourth material, and so on. Other materials may also be added to the removable cleat 10 without including further sets of projections. The coupling element 12 may be made of a third material that is different from the first and second materials used in the plurality of projections 18. If further sets of projections were then added to such a cleat, a third set of projections could be made of a fourth material, a fourth set of projections could be made of a fifth material, and so on. Alternatively, one of the additional sets of projections could be made of the same material as the coupling element. The first set 20 and the second set 22 are preferably interspersed with each other, as shown in the figures. Further, each of these sets of projections may be of different colors.

Figure 4:
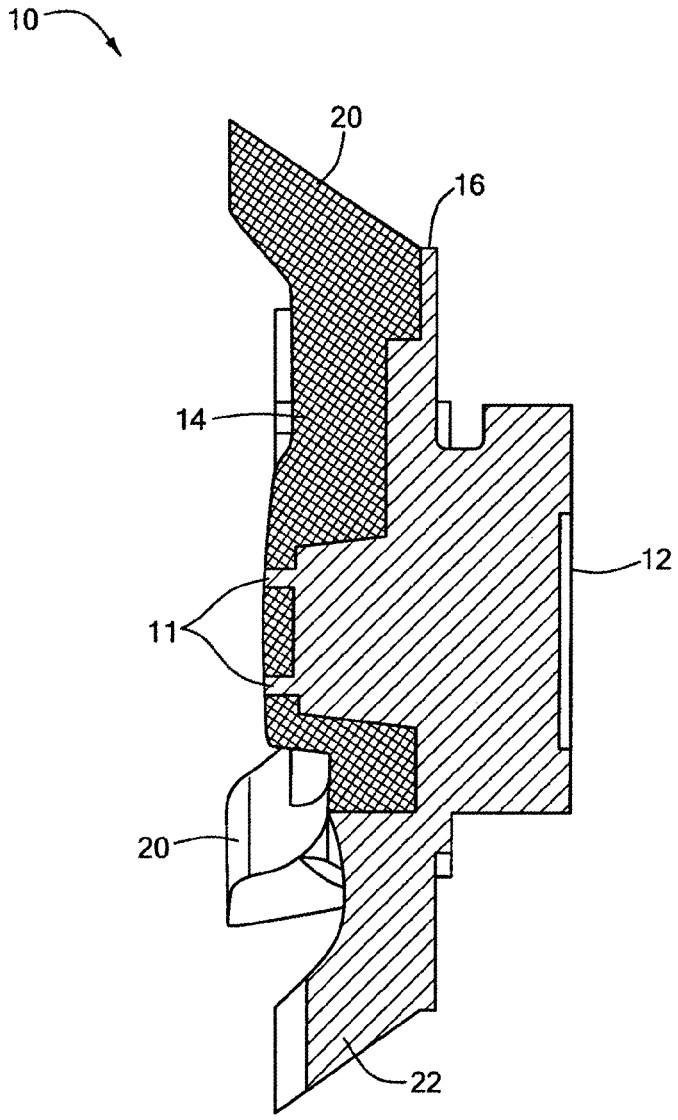
FIG. 4 is a sectional view of the cleat shown in FIG. 3, showing a wear indicator.

Any of the embodiments of the invention described herein may use one or more wear indicators. A single wear indicator 11 is shown as the logo 9, for example, on the removable cleat 10 in FIG. 4, which shows a cross-section of the removable cleat 10 in FIG. 3 along axis A-A. The wear indicator 11 may be used on many of the cleats described herein. The wear indicator 11 is shown in FIG. 4 as being centrally located on the surface of the removable cleat 10 that includes ground-engaging element 14. The wear indicator 11 is a layer of softer material over a harder material; the two materials have different colors. As the removable cleat 10 is used, and the plurality of projections 18 flex, the wear indicator 11 comes into contact with surfaces, causing stress. This stress results in the softer material of the wear indicator 11 beginning to wear away, such that after enough contact with surfaces, the softer materials wear indicator 11 is completely worn away exposing the differently colored harder material underneath. At this time, the user is alerted to the heavy wear on removable cleat 10, which may result in decreased usefulness of the removable cleat 10. Thus, the user is able to replace the removable cleat 10 with a new cleat. The central location shown in FIG. 4 is just one possible placement for the wear indicator 11. For example, a wear indicator 11 may be placed at the end of each longer projection 20, as these projections come into more contact with surfaces than shorter projections 22. A wear indicator 11 may also be placed at the end of each shorter projection 22, if these are made of a less durable material than longer projections 20. It is also possible to place a wear indicator 11 on any or every projection of a cleat, so that when any projection shows wear, the user is alerted to the potential need to replace the cleat.

The first set of projections 20 may be longer than the second set of projections 22, and made of a material that is softer than the material of second set of projections 22. The softer material that composes the first set of projections 20 may be made of, for example but not limited to, a thermoplastic urethane, acetal resin, nylon, or thermoplastic rubber. For a thermoplastic urethane used as a softer material, the durometer may be in the range of 60 shore A to 90 A, and in a preferred embodiment is 90 shore A. Thermoplastic urethanes, acetal resins, and nylons can also be used as the material for harder projections, such as the first set of projections 21. In this case, the durometer may range from 95 shore A to S60D, with the preferred embodiment being 95 shore A. It is also possible to use one of these harder graded materials to make the coupling element 12. The first set of projections 20, being longer and made of a softer material, would come into contact with a surface first and bend more easily, causing less damage to the surface. The second set of projections 22, being shorter and made of a harder material, would provide additional support and stability on surfaces. The flexibility of the first set of projections 20 may be increased, as well. For example, as is known in the prior art, the structure and shape of the projections may increase their flexibility. Such an example is when the cross-section of the projection is made smaller or thinner Thus, it is possible to make projections of a particular structure and shape with different materials, effectively increasing the possible amount of flexibility in the projection. It is also possible to vary the structure and shape of projections within a set, further increasing the different characteristics that removable cleat 10 may advantageously use.

Figure 6:
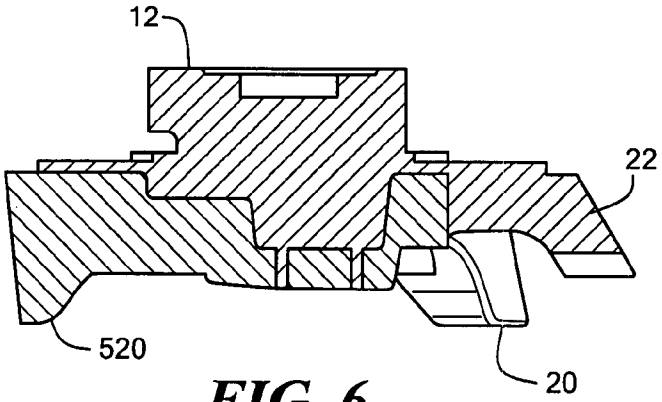
FIG. 6 is a sectional view of the cleat shown in FIG. 5 across line A-A.
Figure 7:
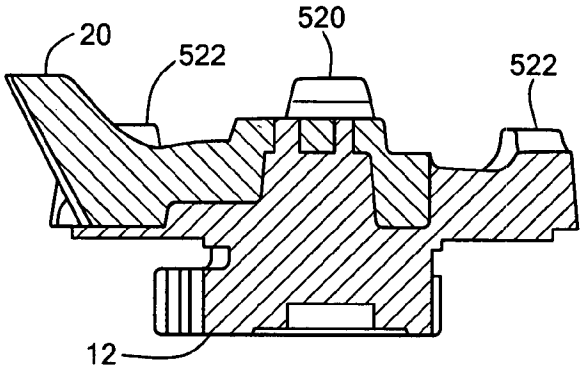
FIG. 7 is a sectional view of the cleat shown in FIG. 5 across line B-B.
Figure 5:
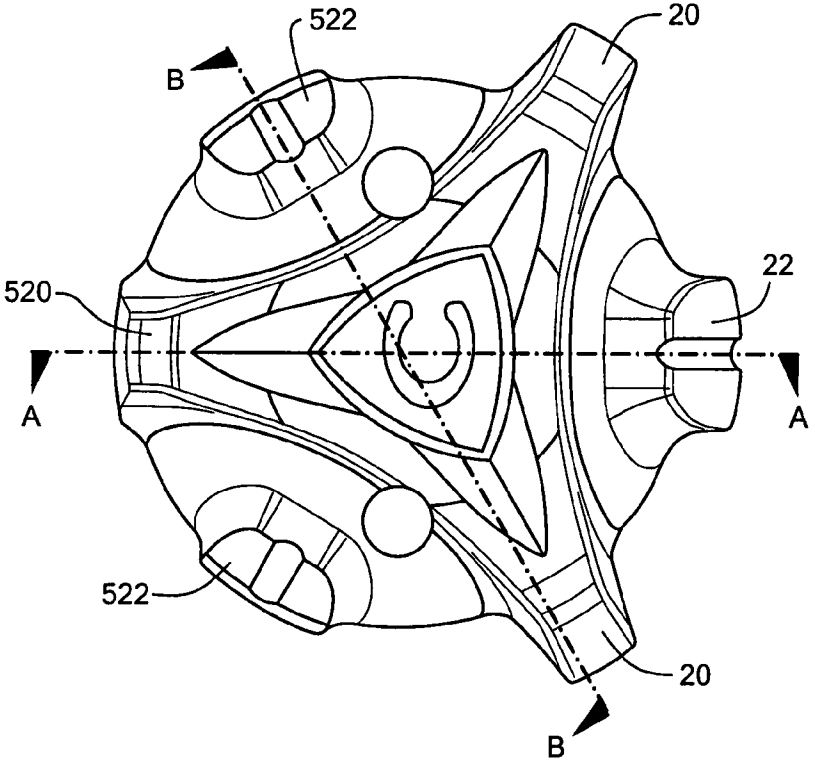
FIG. 5 is a bottom view of a removable cleat according to an alternative embodiment of the current invention.
Figure 8:
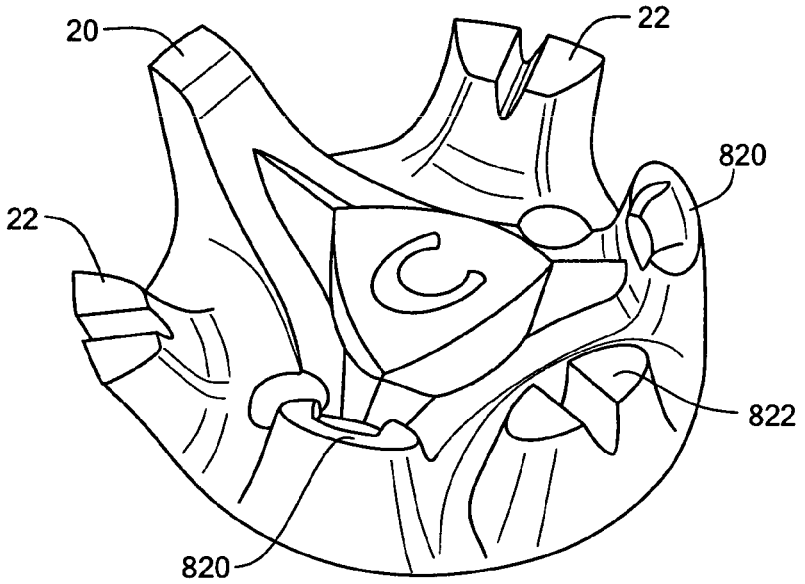
FIG. 8 is a perspective view of a removable cleat according to an alternative embodiment of the current invention.
Figure 9:
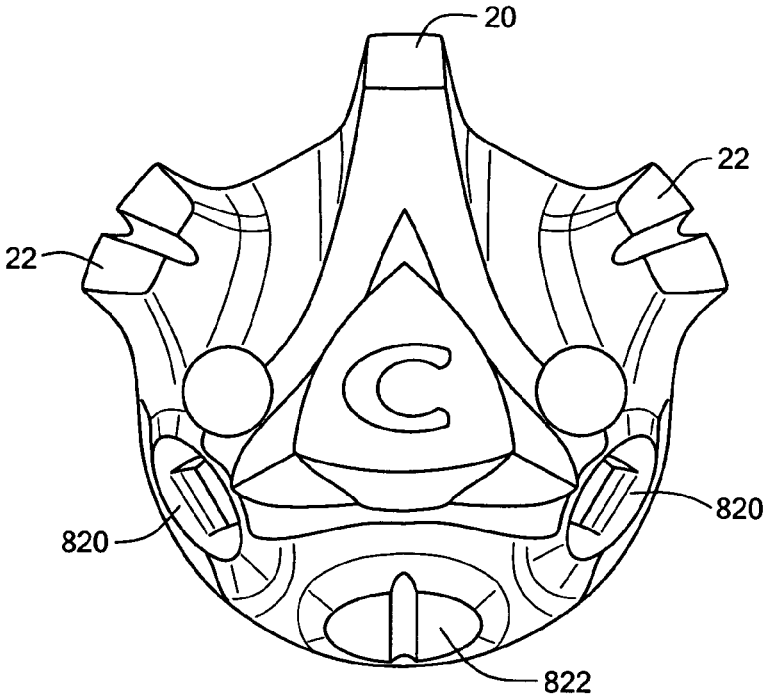
FIG. 9 is a bottom view of the cleat shown in FIG. 8.
Figure 10:
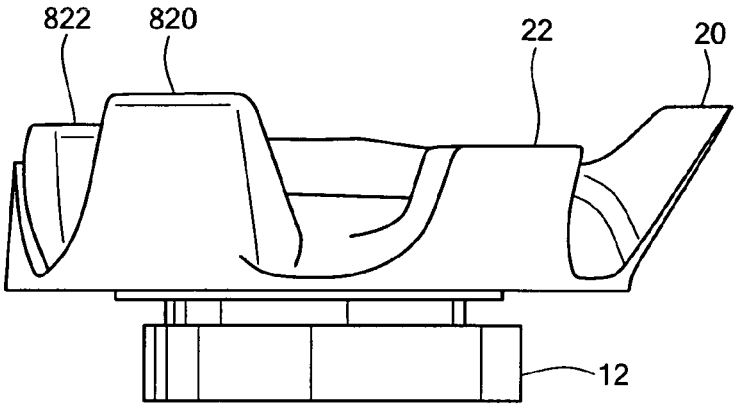
FIGS. 10 and 11 are different side views of the cleat shown in FIG. 8.
Figure 11:
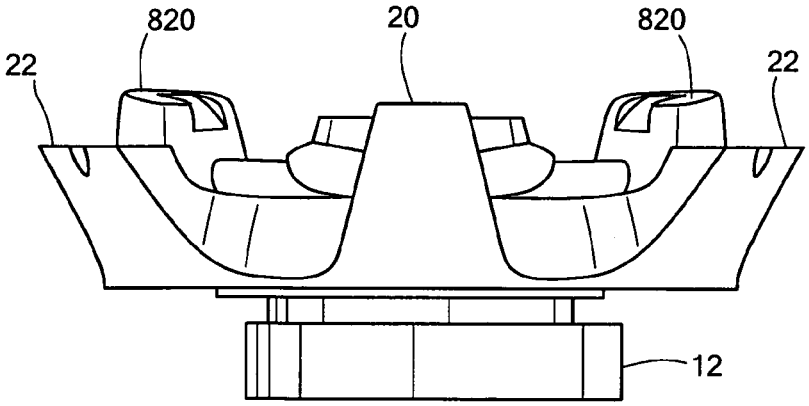
Figure 13:
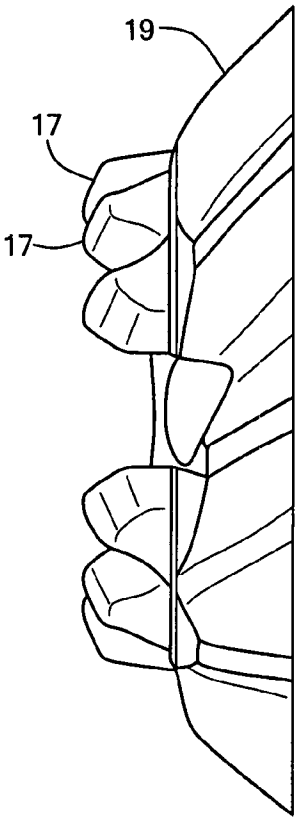
FIGS. 13 and 14 are different side views of the ground-engaging portion of the cleat shown in FIG. 12.
Figure 12:
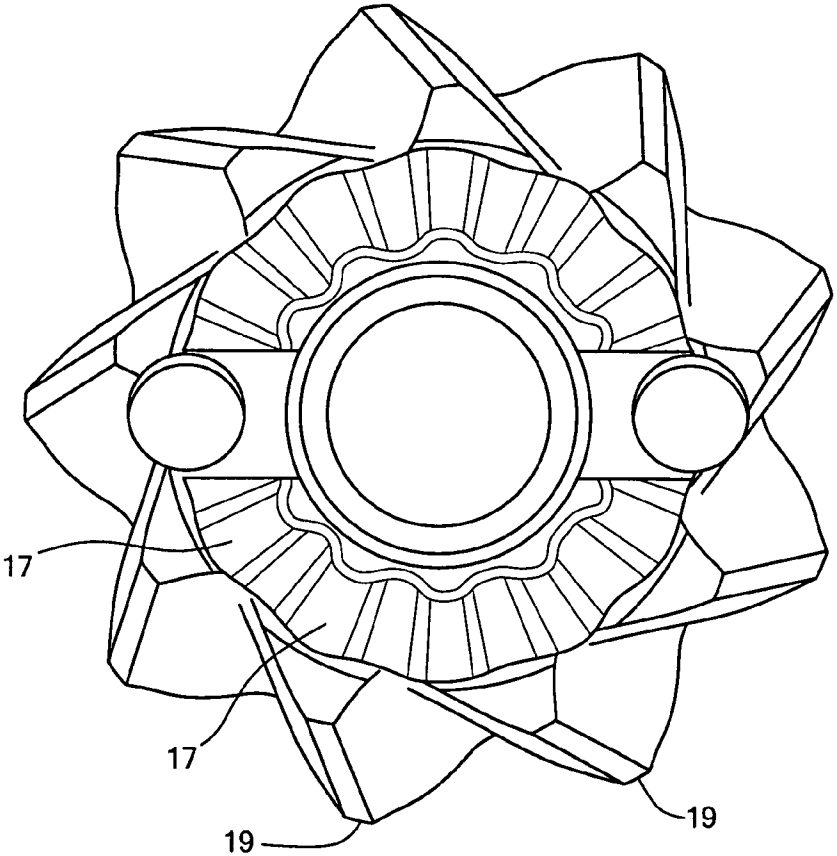
FIG. 12 is a bottom view of a removable cleat according to an alternative embodiment of the current invention.
Figure 14:
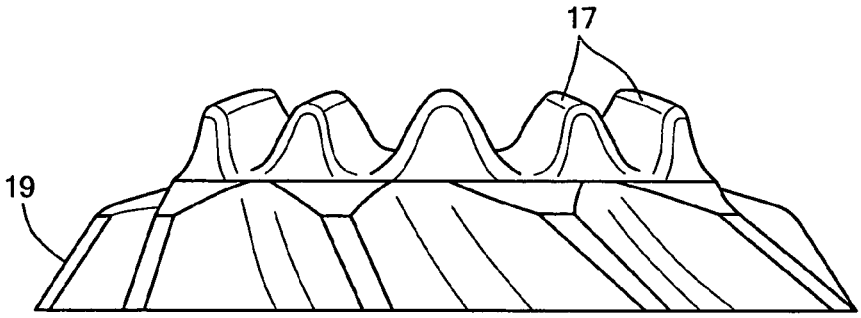
Figure 15:
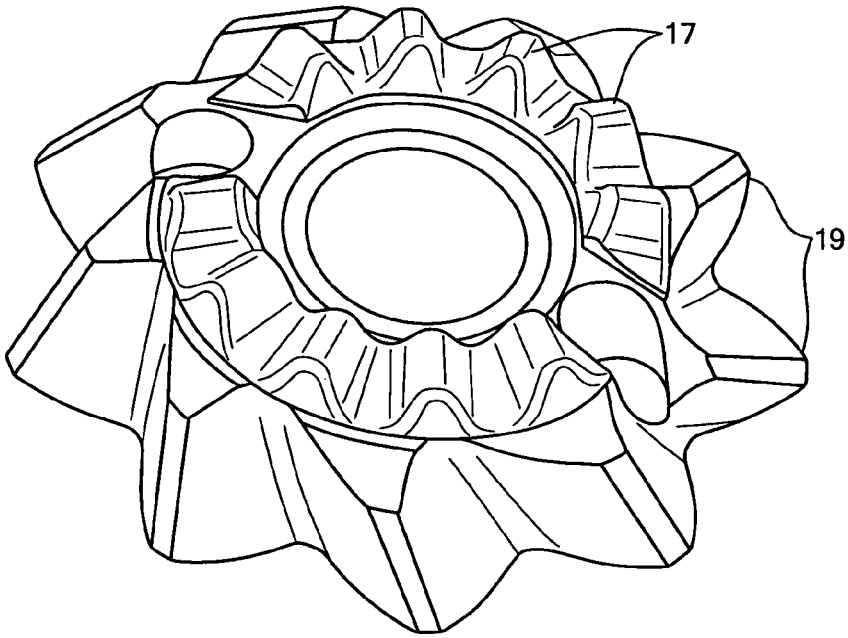
FIG. 15 is a perspective view of the cleat shown in FIG. 12.

FIGS. 5-7 show a variation of the cleat shown in FIGS. 3 and 4, wherein three of the six projections are disposed substantially perpendicular to the shoe sole—i.e., substantially perpendicular to the ground—and wherein the remaining three projections are angled outwardly from the cleat's vertical axis. The substantially perpendicular projections 520, 522 are thus oriented so as to be compressed when the shoe engages the ground. Instead of projecting perpendicularly, these projections may be angled inwardly. The outwardly angled projections 20, 22 are oriented to deflect when the shoe engages the ground. In this embodiment, one substantially perpendicular projection 520 is longer and made from a softer material than the remaining two substantially perpendicular projections 522. Two outwardly angled projections 20 are made of the same material as the longer substantially perpendicular projection 520, and one outwardly angled projection 22 is made of the same material as the shorter substantially perpendicular projections 522; the former material being softer than the latter material. As can be seen in FIGS. 5-7, the softer outwardly angled projections 20 are longer than the harder outwardly angled projection 22. As can also be seen in the embodiment shown in FIGS. 5-7, the ends of all the projections 20, 520 made from the softer material are at approximately the same distance from the shoe sole, and the ends of all the projections 22, 522 made from the harder material are at approximately the same distance from the shoe sole. It will be appreciated that the arrangement of projections shown in FIGS. 5-7 provides directional traction, and when used, for instance, with a Q-lok-type receptacle, the user can orient the direction of the cleat in one of three different directions depending on the conditions and the desires of the user.

FIGS. 8-11 show another variation of the cleat shown in FIGS. 3 and 4, and the cleat shown in FIGS. 5-7. As with the cleat shown in FIGS. 5-7, the cleat shown in FIGS. 8-11 has three substantially perpendicular projections 820, 822, which are oriented so as to be compressed when the shoe engages the ground, and three outwardly angled projections 20, 22, which are oriented to deflect when the shoe engages the ground. In this embodiment, two of the softer, longer projections 820 are substantially perpendicular, and only one of the shorter, harder projections 822 is substantially perpendicular. Only one of the softer, longer projections 20 is outwardly angled, and two of the shorter, harder projections 22 are outwardly angled. It will be appreciated that different numbers of projections, and different arrangements of harder, shorter projections and softer, longer projections may be used and fall within the scope of the invention.

Further, the various different materials that form the different groups of projections in a directional cleat, as described by example above, may each be a different color. Such coloring may be used to help ease correct installation of such a directional cleat. For example, the outsole of the shoe may be marked with different colors in order to assist the wearer in the aligning the cleats in the preferred manner.

FIGS. 12-15 show another removable cleat according to the current invention. The perimeter of the removable cleat shown in FIGS. 12-15 defines an unconventional shape, as compared with, for example, the perimeter of the removable cleat shown in FIG. 1. Regardless of shape, the perimeter of the removable cleat may be said to define a plane. In FIGS. 12-15, the plurality of projections includes two sets of projections, with each set oriented in a different direction relative to the plane formed by the perimeter. A plurality of ground projections 17 extend, for example, in a direction that is substantially perpendicular to the plane, i.e., substantially perpendicular to the ground. The plurality of ground projections 17 are made of a first material. A plurality of side projections extends, for example, in a direction that is substantially parallel to the plane, i.e., substantially parallel to the ground. The plurality of side projections 19 are made of a second material that is different from the material used to make the plurality of ground projections 17. In a preferred embodiment, the plurality of side projections 19 are longer than the plurality of ground projections 17, and the first material that composes the plurality of ground projections 17 is softer than the second material that composes the plurality of side projections 19.

The plurality of projections may include further groupings made in the manner described above, such that there could be a group of projections made of a third material and oriented in a third direction relative to the plane, a group of projections made of a fourth material oriented in a fourth direction relative to the plane, and so on. Further, it is possible for other materials to be incorporated into the removable cleat without adding other projections. For example, the coupling element of the removable cleat may be made of a third material. If a further grouping or groupings of projections were included in such a cleat, the third group of projections could be made of a fourth material, the fourth group of projection could be made of a fifth material, and so on.

The embodiment of the removable cleat shown in FIGS. 12-15 could be configured in other ways as well. The cleat may include a set of angled projections that are oriented at an acute angle to the plane formed by the perimeter, i.e., at an acute angle to the ground. The angled set of projections could be made of a second material. The angled set of projections could include at least one projection that extends beyond the perimeter of the removable cleat. Alternatively, the angled projections are short enough so as to not extend beyond the perimeter of the removable cleat. In a preferred embodiment, the set of projections that are substantially parallel to the plane are longer than the angled set of projections, and the second material that composes the set of angled projections is softer than the first material that composes the set of projections that are substantially parallel to the plane.

The plurality of projections of this embodiment could further include other sets of projections oriented at different acute angles than the set of angled projections, with each set of projections made of a further different material. Additionally, one of the other sets of projections may be oriented in a direction substantially perpendicular to that of the plane formed by the perimeter, and made of a different material.

Figure 16:
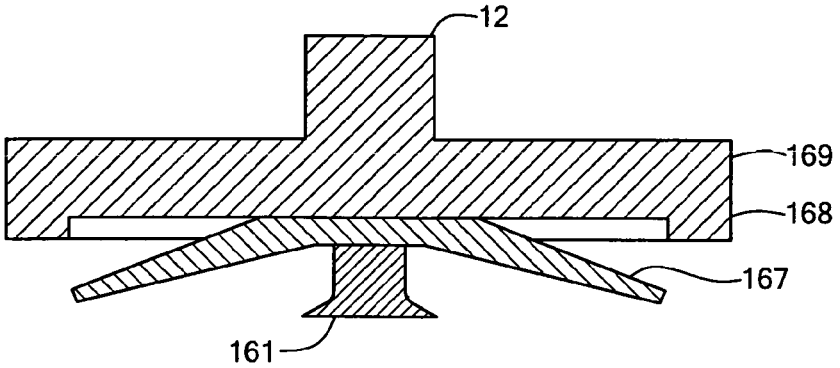
FIG. 16 is a sectional view of a removable cleat according to an alternative embodiment of the current invention.

FIG. 16 shows a sectional view of a cleat according to an alternative embodiment of the current invention. The cleat depicted in FIG. 16 is made of three different materials, all of which are thermoplastic in a preferred embodiment. The bottom-most portion 161 may be made of the softest material so as to comfortably cushion impacts on hard surfaces. This soft bottom-most portion 161 may have a suction-cup shape at its bottom end so as to improve traction on certain types of surfaces. This soft bottom-most portion 161 is preferably located at the cleat's central axis, as shown in FIG. 16. Over and surrounding the bottom-most portion 116 is a second material forming a set of flexible fingers 167, radiating outwardly and tilting downwardly when no force is being applied to them. This second material is harder than the bottom-most portion's material but nevertheless has sufficient flexibility to permit the fingers 167 to bend upwardly when they come into contact with the ground. Over the fingers 167 is a relatively rigid portion 169, which may be disk-shaped and which is made of a third material. This third material is more rigid than the first two materials, from which the bottom-most portion 161 and the fingers 167 are made. In an alternative embodiment, both the fingers 167 and the rigid portion 169 are made of the same material; in this embodiment, the fingers are thin in order to make them more flexible than the rigid portion.

The rigid portion 169 may have a downwardly protruding rim 168 on its bottom surface at its periphery. Such a rim 168 improves traction on certain types of surfaces. This rim 169 may include crenellations that further improve the traction on certain types of surfaces. These crenellations may also be lined up with the fingers 167 so that the fingers are received into the crenellations when the fingers are bent upwardly. The coupling element 12 may also be made of the third material, or alternatively it may be made of a fourth material, such as a harder thermoplastic or a metal.

Figure 17:
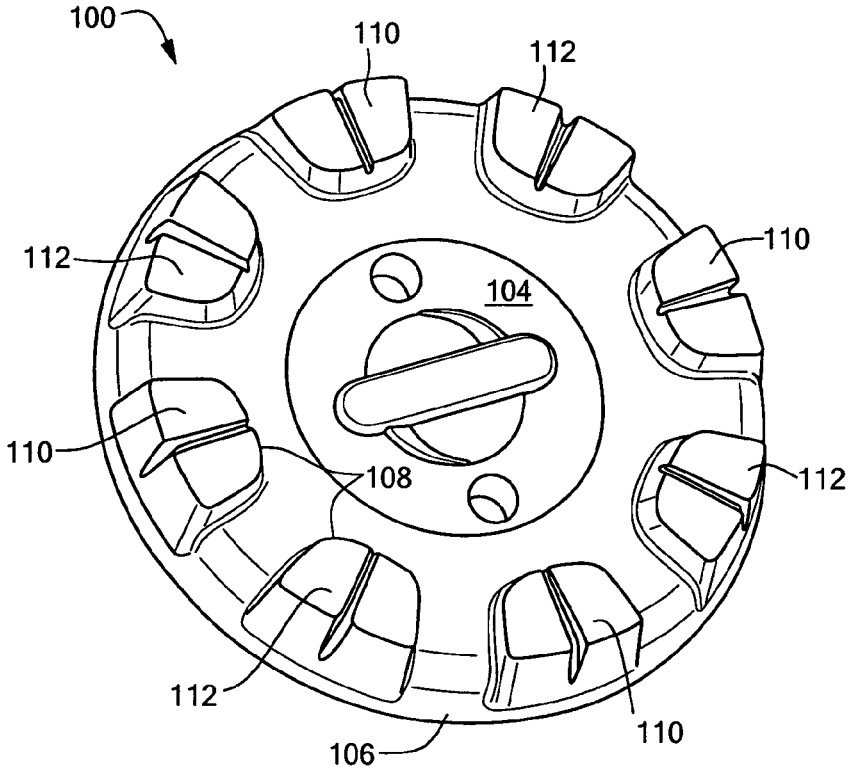
FIGS. 17-19 are perspective views of removable cleats according to alternative embodiments of the current invention.
Figure 18:
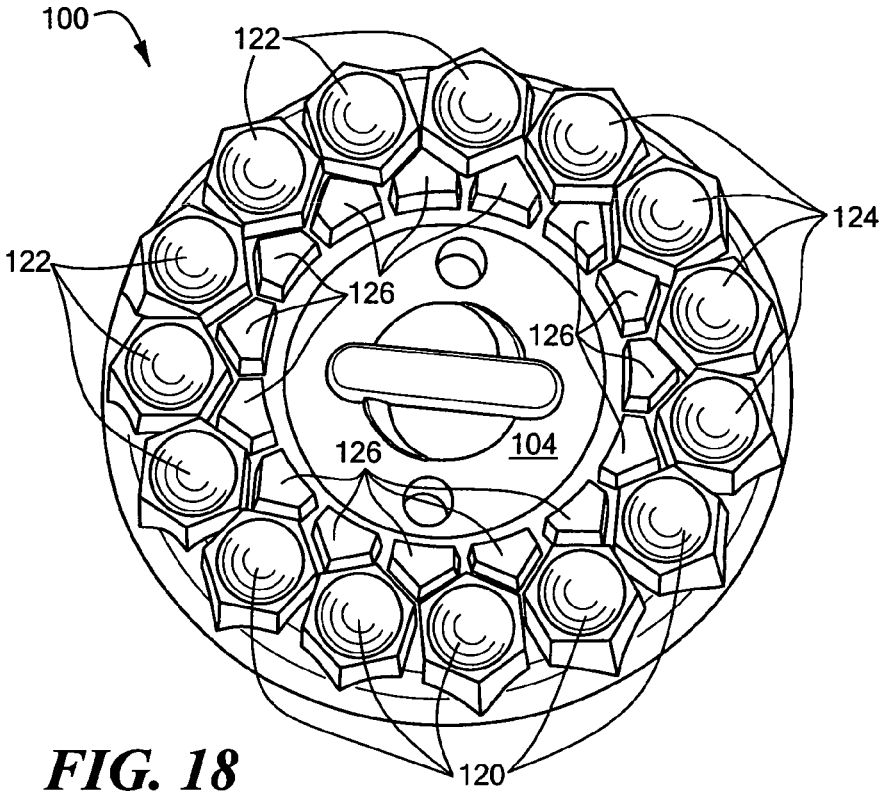
Figure 19:
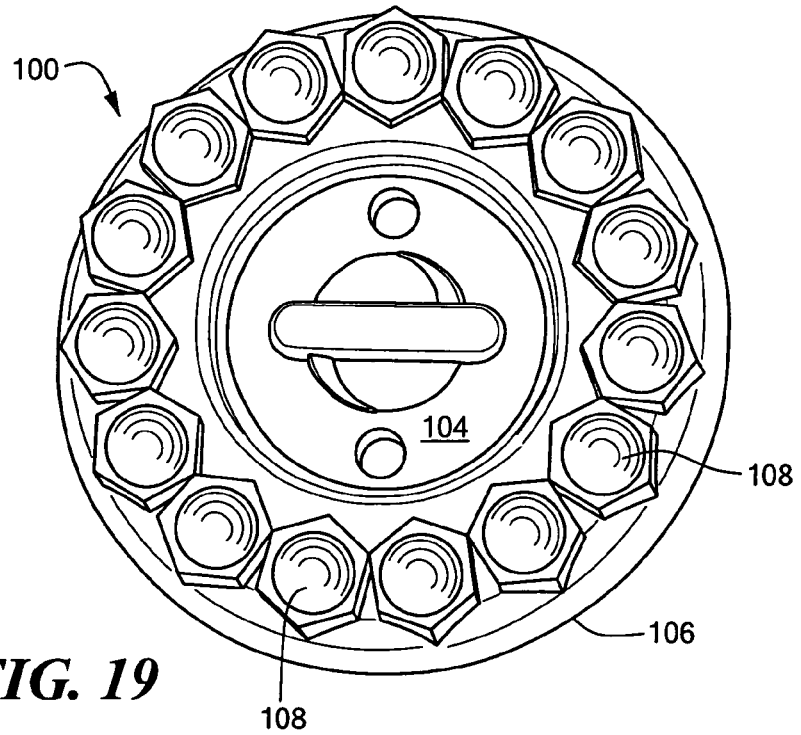

FIGS. 17-19 show various embodiments of cleats that may be used in the current invention. In FIGS. 17-19, an oversized cleat 100 has a coupling element and a ground-engaging element 104. The oversized cleat 100 has a perimeter 106. Disposed adjacent the perimeter 106 are a plurality of projections 108. The plurality of projections 108 do not extend beyond the perimeter 106. The oversized cleat 100 may also have a plurality of projections 126 that are located internally from the perimeter 106 on the surface of the ground-engaging element 104, for example, as seen in FIG. 18. In any of FIGS. 17-19, the plurality of projections 108 may be grouped into two or more sets of projections. For example, in FIG. 17, some of the plurality of projections 108 may be part of a first set 110, and some part of a second set 112. The first set 110 may be made of a first material, and the second set 112 may made of a second different material. As shown in FIG. 17, the projections of the first set 110 may be interspersed with the projections of the second set 112. It is possible to divide the plurality of projections 108 into any number of sets, with each set of projections made of a different material. For example, in FIG. 18, the plurality of projections 108 may be grouped into a first set 120, a second set 122, a third set 124, and a fourth set 126, with each set made of a different material. In the embodiment shown in FIG. 18, the outer projections 120, 122, 124 have convex bottom surfaces. In the embodiment shown in FIG. 19, the projections 108 have concave bottom surfaces.

The oversized cleat 100 may be made to rotate when attached to a shoe using, for example, a primary connector as used in the MacNeill Engineering Q-lok™ System (described in, for example, U.S. Pat. No. 5,768,809, issued Jun. 23, 1998). The direction of rotation may be limited by a ratchet, such that the oversized cleat 100 is able to rotate in only one direction as determined by placement of the ratchet. This limited rotation direction may be desirable. For example, during a proper golf swing, the back leg and foot of the golfer rotate in the direction of the swing, such that the back foot points in the direction of travel of the golf ball at the completion of the swing. Though the back foot and leg rotate, ideally the foot should not otherwise move. A shoe for the back foot containing a rotating cleat such as the oversized cleat 100 would thus be advantageous. The ratchet of oversized cleat 100 could be configured such that oversized cleat 100 could rotate to permit the wearer's foot to point in the direction of travel of the golf ball. The rotating oversized cleat 100 would be placed on the front of the outsole of the shoe that the golfer wears on his or her back foot. The oversized cleat 100 would thereby provide traction to help minimize any motion of the back foot other than the desired rotation motion, while easily allowing the desired rotation motion to occur. Used in this manner, the oversized cleat 100 could help improve a golfer's swing. A non-rotating oversized cleat may be placed on the front of the outsole of the shoe that the golfer wears on his or her front foot. Conventionally sized cleats, and in a preferred embodiment directional cleats, may be located on the back of the outsoles.

As discussed above, the coupling element may comprise conventional threading, multiple-start threads, such as shown in U.S. Pat. No. 5,974,700, or the connectors described in U.S. Pat. No. 6,631,571 or 5,768,809. In an alternative embodiment, the coupling element may be adaptable so that the cleat may be received into different types of receptacles. A simple example of such an adaptable coupling element is one that may be accepted into a conventional metal threaded socket, or by using an adapter, may be accepted into a large-thread plastic socket. The adapter may have on its inner diameter conventional threading, so that the adapter may be screwed on over the metal threads of the coupling element. The adapter's outer diameter would have threads compatible with a large-thread socket. Thus, without the adapter, the cleat may be accepted into a conventionally threaded metal socket, and with the adapter, the cleat may be accepted into a plastic large-thread socket. Other types of adapters may be used to convert different types of coupling elements to work in different types of receptacles.

The present invention may be embodied in other specific forms without departing from the true scope of the invention.

The described embodiments are to be considered in all respects as illustrative only and not restrictive.

We claim:

1. A removable cleat comprising:

a coupling element; and a ground-engaging element, the ground-engaging element having a perimeter, a first and second side, and a plurality of projections attached to the first side of the ground-engaging element, wherein the plurality of projections include at least an external set of projections at the perimeter of the ground engaging element, and an internal set of projections substantially internal to the external set of projections, wherein the external set of projections is made of a different material from the internal set of projections, wherein the internal set of projections is aligned between every external projection in the external set of projections.

2. The removable cleat according to claim 1, wherein the different materials have different hardness.

3. The removable cleat according to claim 1, wherein the internal set of projections includes at least a first set of projections made of a first material and a second set of projections made of a second material, the first set of projections interspersed with the second set of projections.

4. The removable cleat according to claim 3, wherein the first material is softer than the second material.

5. The removable cleat according to claim 1, wherein the external set of projections includes at least a first set of projections made of a first material and a second set of projections made of a second material, the first set of projections interspersed with the second set of projections.

6. The removable cleat according to claim 5, wherein the internal set of projections includes at least a third set of projections made of a third material and a fourth set of projections made of a fourth material, the third set of projections interspersed with the fourth set of projections.

7. The removable cleat according to claim 6, wherein the coupling element is made of the third material.

8. The removable cleat according to claim 5, wherein the external set of projections includes a third set of projections made of a third material interspersed with the first set of projections and the second set of projections.

9. The removable cleat according to claim 1, wherein at least a portion of the external set of projections borders at least a portion of the internal set of projections.

10. The removable cleat according to claim 1, wherein the external set of projections is a different shape than the internal set of projections.

11. The removable cleat according to claim 1, wherein the external set of projections is a different size than the internal projections.

12. The removable cleat according to claim 5, wherein the first material is softer than the second material.

13. The removable cleat according to claim 1, wherein the different materials are characterized by a different color.

14. The removable cleat according to claim 1, wherein the internal projections and external projections extend perpendicular to the first side.

15. The removable cleat according to claim 1, wherein the projections of the external set of projections extend beyond the perimeter.

16. The removable cleat according to claim 1, wherein the cleat is configured to rotate when attached to a shoe.

17. The removable cleat according to claim 16, wherein the cleat is able to rotate in only one direction.

* * * * *